US012152842B2

(12) United States Patent
Tajima et al.

(10) Patent No.: US 12,152,842 B2
(45) Date of Patent: Nov. 26, 2024

(54) HEAT EXCHANGER MEMBER, HEAT EXCHANGER, AIR CONDITIONER, AND REFRIGERATOR

(71) Applicant: YAMAICHI SPECIAL STEEL CO., LTD., Nagoya (JP)

(72) Inventors: Hideharu Tajima, Nagoya (JP); Motoki Takagawa, Nagoya (JP)

(73) Assignee: YAMAICHI SPECIAL STEEL CO., LTD., Nagoya (JP)

( * ) Notice: Subject to any disclaimer, the term of this patent is extended or adjusted under 35 U.S.C. 154(b) by 561 days.

(21) Appl. No.: 17/612,303

(22) PCT Filed: Sep. 11, 2020

(86) PCT No.: PCT/JP2020/034385
§ 371 (c)(1),
(2) Date: Nov. 18, 2021

(87) PCT Pub. No.: WO2021/054247
PCT Pub. Date: Mar. 25, 2021

(65) Prior Publication Data

US 2022/0260327 A1 Aug. 18, 2022

(30) Foreign Application Priority Data

Sep. 20, 2019 (JP) ..... 2019-171108

(51) Int. Cl.
*F28F 13/18* (2006.01)
*F24F 1/0059* (2019.01)
(Continued)

(52) U.S. Cl.
CPC ..... *F28F 13/18* (2013.01); *F24F 1/0059* (2013.01); *F28F 1/32* (2013.01); *F28F 19/00* (2013.01); *F28F 19/02* (2013.01)

(58) Field of Classification Search
CPC .... F28F 13/19; F28F 1/32; F28F 19/00; F28F 19/02; F24F 1/0059
(Continued)

(56) References Cited

U.S. PATENT DOCUMENTS 5,693,236 A 12/1997 Okumura et al.
6,156,409 A 12/2000 Dushita et al.
(Continued)

FOREIGN PATENT DOCUMENTS

CN 102732752 A 10/2012
CN 106662415 A 5/2017
(Continued)

OTHER PUBLICATIONS

Office Action issued Jan. 10, 2024 for Chinese Patent Application No. 202080036676.X (8 pages in Chinese; 9 pages English translation).
(Continued)

*Primary Examiner* — Joel M Attey
(74) *Attorney, Agent, or Firm* — Smith, Gambrell & Russell, LLP

(57) ABSTRACT

A highly efficient heat exchanger member is realized by providing, to a metal surface, a characteristic that is not found in the metal itself with a coating film excelling in thermal conductivity.

A heat exchanger member is made of metal, and includes a carbon-containing oxide film (112B) provided on the metal surface and having fine concave-convex portions (112C). An average spacing between apexes of convex portions of the fine concave-convex portions (112C) is greater than or equal to 40 nm and less than or equal to 120 nm, and an average value of differences in height between apexes of adjacent
(Continued)

convex portions and bottom points of concave portions is greater than or equal to 30 nm and less than or equal to 250 nm.

20 Claims, 9 Drawing Sheets

(51) Int. Cl.
*F28F 1/32* (2006.01)
*F28F 19/00* (2006.01)
*F28F 19/02* (2006.01)

(58) Field of Classification Search
USPC ..... 165/133
See application file for complete search history.

(56) References Cited

U.S. PATENT DOCUMENTS

| | | | | |
|---|---|---|---|---|
| 10,107,574 | B2 * | 10/2018 | Yamada | F24D 17/0073 |
| 10,793,748 | B2 | 10/2020 | Yamamoto et al. | |
| 11,280,563 | B2 | 3/2022 | Yamada et al. | |
| 2017/0227305 | A1 | 8/2017 | Yamada et al. | |
| 2018/0142129 | A1 * | 5/2018 | Yamamoto | C09D 201/04 |
| 2018/0252484 | A1 | 9/2018 | Yamada et al. | |

FOREIGN PATENT DOCUMENTS

| | | | |
|---|---|---|---|
| CN | 208419712 | U | 1/2019 |
| JP | H07-316546 | A | 12/1995 |
| JP | H1026491 | A | 1/1998 |
| JP | 11-91024 | A | 4/1999 |
| JP | 11-100234 | A | 4/1999 |
| JP | 2006-242390 | A | 9/2006 |
| JP | 2013-092289 | A | 5/2013 |
| JP | 2013-103414 | A | 5/2013 |
| JP | 2019-167622 | A | 10/2019 |
| WO | 2016/181676 | A1 | 11/2016 |

OTHER PUBLICATIONS

International Search Report for PCT/JP2020/034385, dated Nov. 2, 2020 (7 pgs. with English translation).

* cited by examiner

FIN OF PRESENT INVENTION

COMPARATIVE FIN

HEAT EXCHANGER MEMBER, HEAT EXCHANGER, AIR CONDITIONER, AND REFRIGERATOR

TECHNICAL FIELD

The present invention relates to a heat exchanger member having a metal surface provided with characteristics other than the characteristics inherent to the metal, and a device including the member.

BACKGROUND ART

When the air conditioner is in operation, dew condensation or frosting generates on the surfaces of the heat exchanger fins of the heat exchanger provided in an indoor unit and an outdoor unit. The dew condensation and frosting on the surfaces of the heat exchanger fins adversely affect, for example, heat exchangeability may be lowered, air blowing efficiency may be lowered, and power consumption of the air conditioner itself accompanying therewith may be increased. In recent years, in the field of air conditioning, techniques related to water repellency have been actively studied as measures against dew condensation and frosting on the surfaces of the heat exchanger fins. Such a technique is disclosed in, for example, Patent Literature 1.

Patent Literature 1 describes a method for suppressing dew condensation, frosting, and the like that generate in a beat exchanger by forming a coating composition including a water-soluble organic solvent that dissolves a fluororesin, a fluororesin, hydrophilic silica particles, and hydrophobic silica particles on a surface of the heat exchanger.

CITATIONS LIST

Patent Literature

Patent Literature 1: WO 2016/181676

SUMMARY OF INVENTION

Technical Problems

However, in the technique of Patent Literature 1 silica particles having a thermal conductivity significantly lower than that of aluminum which is a general material of a heat exchanger fin of a heat exchanger or that of aluminum oxide naturally formed on the surface thereof (about 1/20 of the thermal conduction rate of aluminum oxide), and an organic material having a heat conductivity generally lower than that of a metal or a metal oxide film are used. For this reason, there has been a problem that the coating composition itself, which is supposed to be a countermeasure against the increase in the power consumption of the air conditioner, may increase the power consumption of the air conditioner when the air conditioner is operated in an environment where no dew condensation or the like generates.

Furthermore, in recent years, it has been found that the water repellent treatment that merely excels in contact angle and sliding angle does not have a large effect on actual adhesion of water droplets caused by dew condensation (the reason has not, yet been clarified at the present time). Thus, a technique for performing the water repellent treatment on a heat exchanger has not been put into practical use, and countermeasures by a hydrophilic treatment passive against dew condensation and frosting have been implemented.

The present invention has been made in view of the above problems, and an object thereof is to provide a heat exchanger member, a heat exchanger, an air conditioner, and a refrigerator that are highly efficient by providing, to a metal surface forming a heat exchanger and a heat exchanger fin of the heat exchanger, a characteristic not found in the metal itself with a coating film excelling in thermal conductivity.

Solutions to Problems

In order to solve the above problems, a heat exchanger member according to the present invention is a heat exchanger member made of metal, the heat exchanger member including a metal oxide film provided on a metal surface, having concave-convex portions, and containing carbon. An average spacing between apexes of convex portions of the concave-convex portions is greater than or equal to 40 nm and less than or equal to 120 nm, and an average value of differences in height between the apexes of adjacent convex portions and bottom points of concave portions is greater than or equal to 30 nm and less than or equal to 250 nm.

Advantageous Effects of Invention

According to the present invention, it is possible to add a function of enhancing heat exchange efficiency of a heat exchanger to a heat exchanger member.

DESCRIPTION OF EMBODIMENTS

First Embodiment

Hereinafter, embodiments of the present invention will be described with reference to FIGS. 1 to 9.

<Configuration of Indoor Unit of Air Conditioner in which Member is Incorporated>

Figure 1:
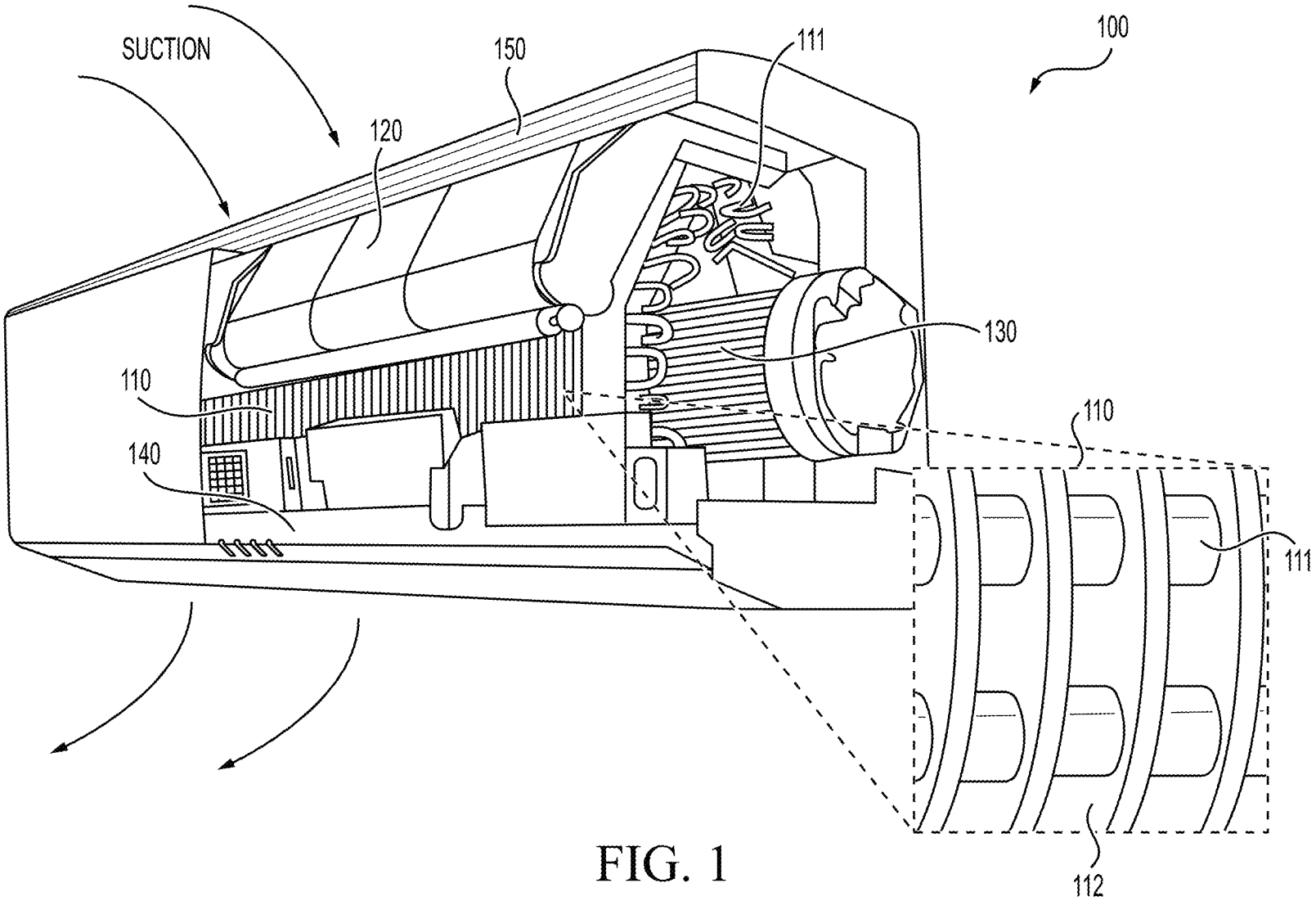
FIG. 1 is a perspective view illustrating an indoor unit of an air conditioner using a heat exchanger member according to a first embodiment of the present invention.

FIG. 1 is a diagram illustrating a cut model of an indoor unit 100 of the air conditioner. The indoor unit 100 of the air conditioner includes a heat exchanger 110, an air filter 120, a blower fan 130, a drain pan 140, a housing 150, a control unit, a drive unit, and the like (not illustrated).

The heat exchanger 110 includes a refrigerant piping 111 and fins 112. A heat exchanger member of the present invention means a member forming the heat exchanger 110 (refrigerant piping 111 and fin 112). In the following description, the heat exchanger member will be described as a member forming the fin 112.

<Configuration of Member>

Figure 2:
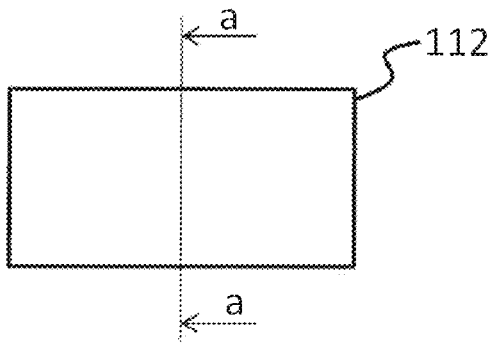
FIG. 2 is a view illustrating a heat exchanger member according to the first embodiment of the present invention.
Figure 3:
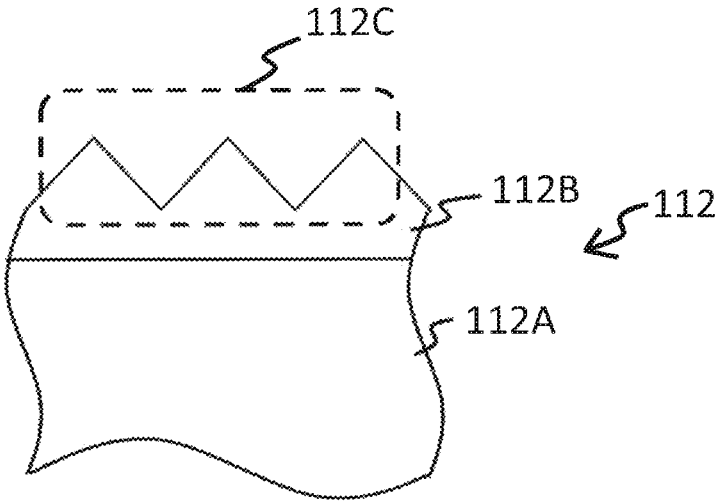
FIG. 3 is a schematic view illustrating a cross section taken along line a-a in FIG. 2.

FIG. 2 and FIG. 3, which is a cross-sectional view taken along line a-a in FIG. 2, are views illustrating the fin 112 forming the heat exchanger 110 which is a specific example of a heat exchanger member of the present invention. As shown in FIG. 3, a carbon-containing oxide film 1128 provided with fine concave-convex portions 112C is provided on a metal base 112A made of a main material (aluminum, stainless steel, copper, etc.) forming the fin 112. The carbon-containing oxide film 112B having the fine concave-convex portions 112C is a metal oxide film containing carbon, and provides a function of enhancing heat exchange efficiency of the heat exchanger 110.

The fin 112 is made of a metal plate such as a rolled aluminum plate, a rolled stainless steel plate, or a rolled copper plate. The thickness of the fin 112 may be 0.05 to 0.50. Furthermore, the thickness of the fin 112 is preferably 0.05 to 0.20 so that, when configured as a heat exchanger, the surface area can be made wider than the fin 112 in the heat exchanger having the same volume. The size is appropriately determined according to the purpose of use.

The carbon-containing oxide film 112B is an oxide of a metal same as or similar to the metal base material, containing carbon. The film thickness of the carbon-containing oxide film 112B may be 40 nm to 300 nm. Furthermore, the film thickness of the carbon-containing oxide film 112B is preferably 100 nm to 300 nm in order to utilize the thermal conductivity of the contained carbons and improve corrosion resistance. The content ratio of carbon contained in the carbon-containing oxide film. 112*n* may be 5 at % to 50 at % at a point of 3 nm to 5 nm from the surface (the surface opposite to the surface in contact with the metal base 112A). Furthermore, the content ratio of carbon contained in the carbon-containing oxide film 112B is preferably 20 at % to 40 at % at a point of 3 nm to 5 nm from the surface in order to provide characteristics given by containing carbon and to maintain the strength of the film.

The carbon contained in the carbon-containing oxide film 112B is preferably a carbon having crystallinity, and is preferably a carbon nanotube, fullerene, graphene, or the like to enhance thermal conduction.

The fine concave-convex portions 112C are provided on the surface of the carbon-containing oxide film 112B (the surface opposite to the surface in contact with the metal base 112A), and an average spacing between the apexes of the convex portions of the fine concave-convex portions 112C is greater than or equal to 40 nm and less than or equal to 120 nm, and an average value of differences in height between the apexes of the adjacent convex portions and the bottom points of the concave portions is greater than or equal to 30 nm and less than or equal to 250 nm. Furthermore, in order to provide further dew condensation prevention properties, the average value of the differences in height between the apexes of the convex portions and the bottom points of the concave portions in the fine concave-convex portions 112 is more preferably greater than or equal to 100 nm and less than or equal to 200 nm Hereinafter, an example according to the first embodiment will be described with reference to FIGS. 5 to 6. The fin 112 in the example is made of an aluminum plate of 67 mm×80 mm×0.3 mm. The following treatment is performed to provide the carbon-containing oxide film 112B having fine concave-convex portions 112C on the surface of the aluminum plate (metal base 112A).

Figure 5:
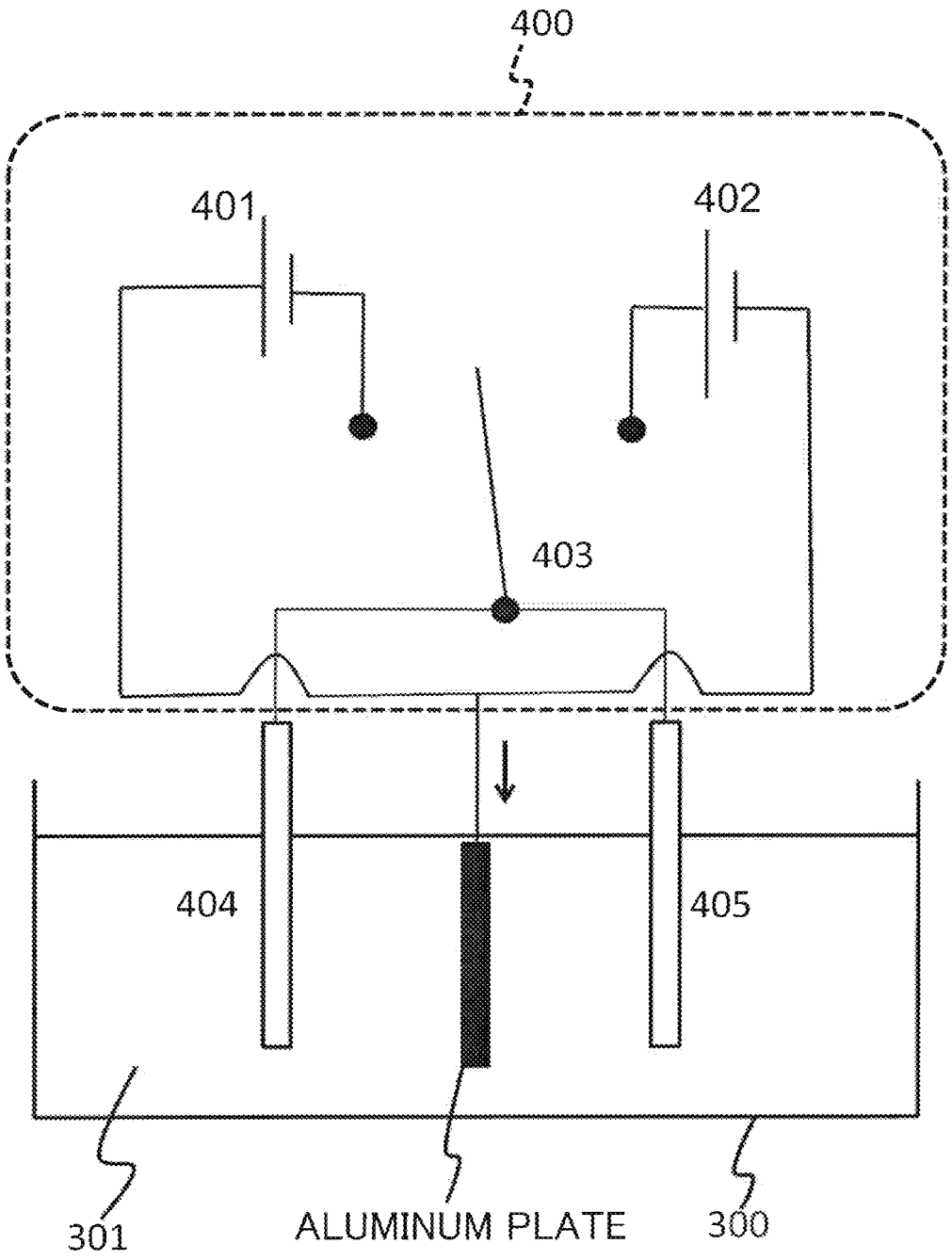
FIG. 5 is a diagram illustrating equipment for manufacturing the first embodiment of the present invention.

First, the aluminum plate (metal base 112A) is immersed and degreased with a sodium hydroxide aqueous solution (immersion time: 5 minutes). Thereafter, as shown in FIG. 5, the aluminum plate connected to the electric circuit 400 and the SUS 304 electrodes 404 and 405 connected to the electric circuit 400 are immersed in a bath 300 containing treatment liquid 301. In the treatment liquid 301 in the bath 300, sodium hydroxide and carbon nanotube dispersion liquid of 5% are added to purified water so as to have concentrations of 1.7 g/l and 40 ml/l, respectively, and the temperature is adjusted so that the liquid temperature becomes 30° C.

Figure 6:
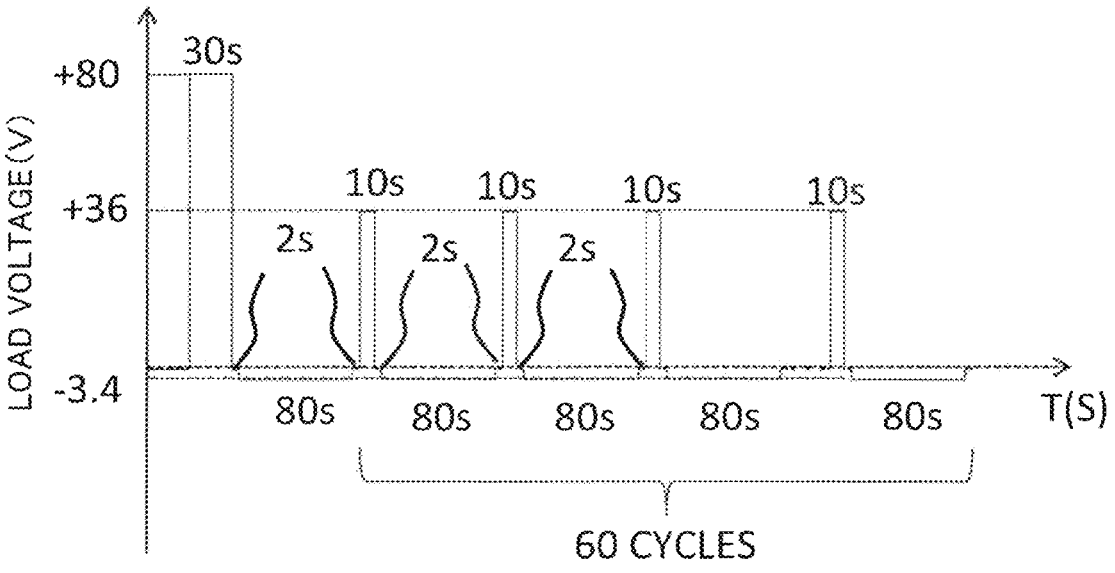
FIG. 6 is a diagram illustrating a time chart of a load electrolysis density for manufacturing the first embodiment of the present invention.

Thereafter, the voltage is loaded on the aluminum plate by a rectifier 401, a rectifier 402, and a changeover switch 403 with the pattern illustrated in FIG. 6, wherein the current flowing in the direction of the arrow illustrated in FIG. 5 is defined as the voltage in the + direction.

Finally, the film is washed with water and dried (80° C. for 30 minutes) in a thermostatic bath. In this way, the carbon-containing oxide film 112E having a thickness of 200 nm is provided on the surface of the aluminum plate (metal base 112A), and at the same time, the fine concave-convex portions 112C are provided on the surface of the carbon-containing oxide film 112B, the average spacing between the apexes of the convex portions in the concave-convex shape being 88 nm, and the average value of the differences in height between the apexes of the adjacent convex portions and the bottom points of the concave portions being 100 nm, thereby obtaining the fin 112.

<Demonstration Test>

Here, characteristics required for the fins forming the heat exchanger will be described. When the heat exchanger is used to take heat from the outside, dew condensation occurs on the fin surface. The dew condensation becomes frost in the outdoor unit of the air conditioner during the heating operation or the refrigerator, which significantly inhibits the heat exchange efficiency of the heat exchanger. Furthermore, in the indoor unit during cooling operation as well, dew condensation inhibits heat conversion efficiency of heat exchange. Thus, by preventing dew condensation, heat exchange efficiency of the heat exchanger can be significantly improved. However, it is difficult to prevent the occurrence of dew condensation itself, and there has been no choice but to cope with the dew condensation by performing water repellent treatment, hydrophilic treatment, or the like on the fin to make the dew condensation water slide down from the fin surface quickly. In this case, although the reason is unknown, at the time of occurrence of dew condensation, even if the contact angle and the sliding angle, which are general indexes indicating water repellency and hydrophilicity, are good, the dew condensation water actually did not slide down as expected with the good contact angle and sliding angle.

Furthermore, the water repellent treatment and the hydrophilic treatment have problems in that the heat exchange rate decreases since silica particles and fluorine particles are provided which have lower thermal conductivity than aluminum oxide naturally formed on the surface of aluminum.

Although the mechanism of the fin 112 forming the heat exchange of the present invention is unknown, it has a remarkable effect of suppressing dew condensation. In addition, since the carbon-containing oxide film 112B is provided which contains carbon having higher thermal conductivity than aluminum oxide on the surface of aluminum, the hear exchange efficiency of aluminum, which is the main material of the fin 112, is not inhibited as compared with a general water repellent treatment or hydrophilic treatment in which silica particles or fluorine particles having lower thermal conductivity than aluminum are provided.

Figure 4:
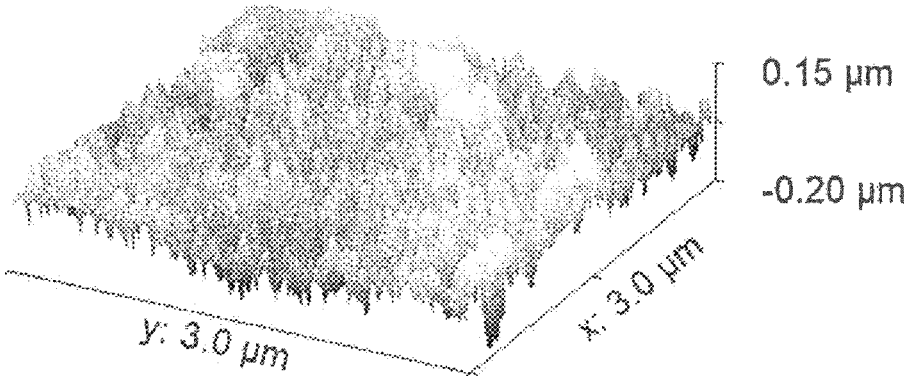
FIG. 4 is an AFM observation result of the surface of the heat exchanger member according to the first embodiment of the present invention.
Figure 8:
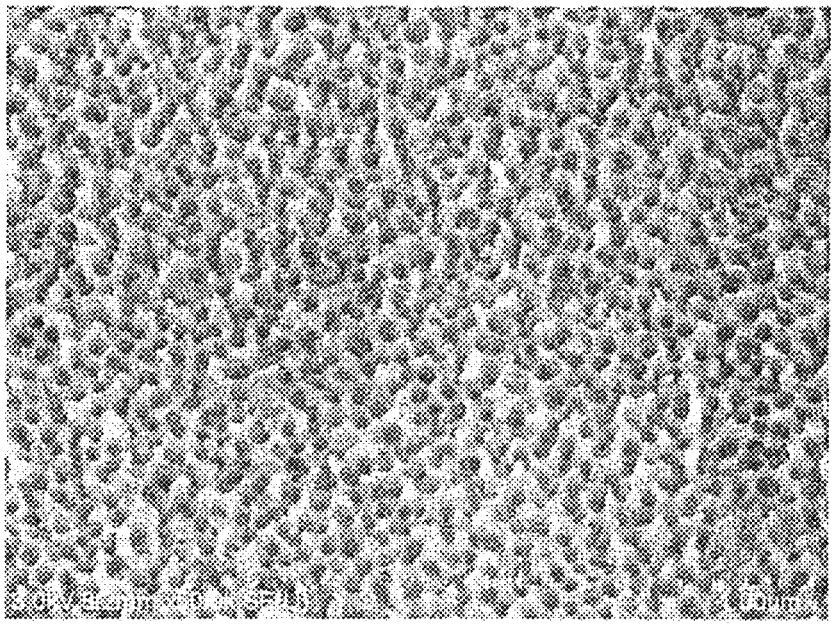
FIG. 8 is an SEM perspective view of the first embodiment of the present invention.
Figure 9:
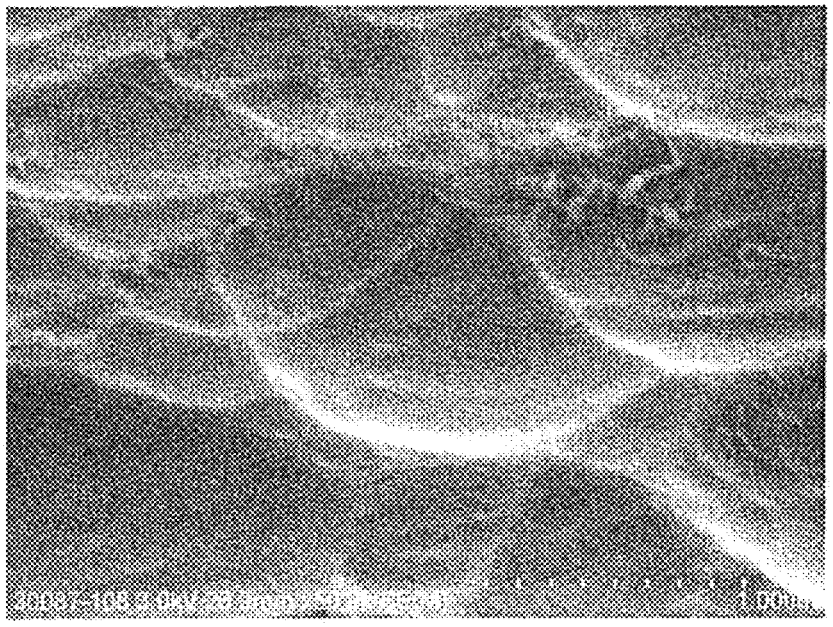
FIG. 9 is an SEM perspective view of a comparative example with respect to the first embodiment of the present invention.

A fin 112 (contact angle: 130°, sliding angle: 30°) forming the heat exchanger of the present invention illustrated in FIGS. 4 and 8 and a comparative fin (contact angle: 130°, sliding angle: 29°) illustrated in FIG. 9 were both installed on a cooler, and a dew condensation test for comparing generation of dew condensation was performed. The comparative fin differs from the present invention in the manufacturing conditions, and although the comparative fin has fine concave-convex portions (Ra: 0.1 μm), the fine concave-convex portions are formed such that an average spacing between the apexes of the convex portions of the concave-convex shape is 1.0 μm, which is wide with respect to the concave-convex portions of the present invention.

Figure 7:
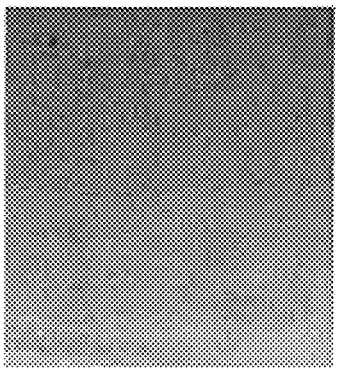
FIG. 7 is a diagram illustrating a dew condensation test result of the first embodiment of the present invention.
Figure 7:
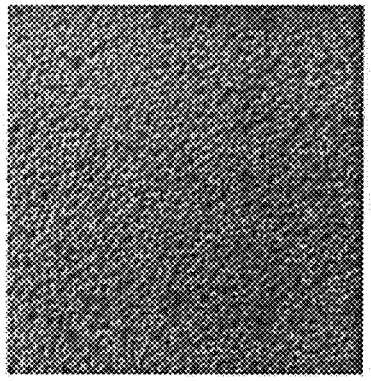

FIG. 7 is a photograph showing a dew condensation state of each fin 60 minutes after the start of cooling. As is clear from FIG. 7, in the fin 112 of the present invention, at least the generation of dew condensation water was not found, and in the comparative fin, adhesion of dew condensation water occurred. In addition, although not illustrated, adhesion of dew condensation water was confirmed also in the fin subjected to hydrophilic coating or water-repellent coating, as in the case of the comparative fin.

In addition, when the surface temperature of each fin was measured with a radiation thermometer at the time of the dew condensation test, at was confirmed that only the fin 112 of the present invention had a lower temperature by 2 to 3° C. as compared with a normal aluminum fin, and it was confirmed that the fin 112 of the present invention exhibited excellent heat exchangeability.

In the present example, in order to form the carbon-containing oxide film 112B having the fine concave-convex portions 112C on the surface, a wet electrolytic treatment under the above conditions is used, but the present invention is not limited thereto, and the carbon-containing oxide film may be formed under other conditions or by other treatment methods (sputtering using a metal oxide target containing carbon nanotubes, sol-gel method, or the like). However, the wet electrolytic treatment is superior to other treatment methods in terms of cost.

As described above, the fin 112 of the present invention has effects of being able to prevent dew condensation and improve the heat exchange rate of the heat exchanger as compared with the water repellent treatment by conventional hydrophilic coating, fluororesin coating, or conventional formation of concave-convex portions.

Furthermore, the first embodiment of the present invention is not limited to the fin 112, and may be, for example, a cooling water piping for a radiator made of copper, or a member forming a water cooling jacket for cooling a power device, and in any case, the same effect as the fin 112 is obtained. In addition, the carbon-containing oxide film 112B also has an effect of improving corrosion resistance of the member.

Moreover, the heat exchanger including members such as the fin 112 has the same effect as the fin 112.

Furthermore, it is apparent that an air conditioner or a refrigerator provided with a heat exchanger including members such as the fin 112 also has the same effect as the fin 112, with the result that the power consumption can be reduced.

The present invention is not limited to the above-described embodiments, and various modifications can be made within the scope defined in the Claims, where embodiments obtained by appropriately combining technical means disclosed in the different embodiments are also included in the technical scope of the present invention.

Furthermore, new technical features can be formed by combining the technical means disclosed in each embodiment.

INDUSTRIAL APPLICABILITY

The present invention can be used for a heat exchanger member that requires dew condensation prevention, frosting prevention, and corrosion resistance.

REFERENCE SIGNS LIST

100 indoor unit of air conditioner
112 fin
112B carbon-containing oxide film (metal oxide film)
112C fine concave-convex portion
300 treatment bath
400 electric circuit

The invention claimed is:

1. A heat exchanger member made of metal, the heat exchanger member comprising:

a metal oxide film provided on the metal surface, having concave-convex portions, and containing carbon, wherein an average spacing between apexes of convex portions of the concave-convex portions is greater than or equal to 40 nm and less than or equal to 120 nm, and an average value of differences in height between apexes of adjacent convex portions and bottom points of concave portions is greater than or equal to 30 nm and less than or equal to 250 nm.

2. The heat exchanger member according to claim 1, wherein a content ratio of carbon contained in a range of 3 to 5 nm from a surface of the metal oxide film is greater than or equal to 20 at % and less than or equal to 40 at %.

3. The heat exchanger member according to claim 1, wherein the metal oxide film has a thickness of greater than or equal to 100 nm and less than or equal to 300 nm.

4. A heat exchanger comprising a heat exchanger fin including the heat exchanger member according to claim 1.

5. An indoor unit for an air conditioner comprising the heat exchanger according to claim 4.

6. An outdoor unit for an air conditioner comprising the heat exchanger according to claim 4.

7. A refrigerator comprising the heat exchanger according to claim 4.

8. The heat exchanger member according to claim 2, wherein the metal oxide film has a thickness of greater than or equal to 100 nm and less than or equal to 300 nm.

9. A heat exchanger comprising a heat exchanger fin including the heat exchanger member according to claim 2.

10. A heat exchanger comprising a heat exchanger fin including the heat exchanger member according to claim 3.

11. A heat exchanger comprising a heat exchanger fin including the heat exchanger member according to claim 8.

12. An indoor unit for an air conditioner comprising the heat exchanger according to claim 9.

13. An indoor unit for an air conditioner comprising the heat exchanger according to claim 10.

14. An indoor unit for an air conditioner comprising the heat exchanger according to claim 11.

15. An outdoor unit for an air conditioner comprising the heat exchanger according to claim 9.

16. An outdoor unit for an air conditioner comprising the heat exchanger according to claim 10.

17. An outdoor unit for an air conditioner comprising the heat exchanger according to claim 11.

18. A refrigerator comprising the heat exchanger according to claim 9.

19. A refrigerator comprising the heat exchanger according to claim 10.

20. A refrigerator comprising the heat exchanger according to claim 11.

* * * * *